US010308892B2

(12) United States Patent
Petlyuk et al.

(10) Patent No.: US 10,308,892 B2
(45) Date of Patent: Jun. 4, 2019

(54) COMPOSITIONS AND USE THEREOF FOR METAL SHAPING

(71) Applicant: Houghton Technical Corp., Wilmington, DE (US)

(72) Inventors: Alla M. Petlyuk, West Chester, PA (US); Salvatore DeSimone, Bridgeport, PA (US)

(73) Assignee: Houghton Technical Corp., Wilmington, DE (US)

( * ) Notice: Subject to any disclaimer, the term of this patent is extended or adjusted under 35 U.S.C. 154(b) by 534 days.

(21) Appl. No.: 14/903,484

(22) PCT Filed: May 22, 2014

(86) PCT No.: PCT/US2014/039096

§ 371 (c)(1),
(2) Date: Jan. 7, 2016

(87) PCT Pub. No.: WO2015/005978

PCT Pub. Date: Jan. 15, 2015

(65) Prior Publication Data

US 2016/0145532 A1 May 26, 2016

Related U.S. Application Data

(60) Provisional application No. 61/845,348, filed on Jul. 11, 2013.

(51) Int. Cl.

| | |
|---|---|
| ***C10M 105/04*** | (2006.01) |
| ***C10M 105/24*** | (2006.01) |
| ***C10M 129/16*** | (2006.01) |
| ***C10M 133/04*** | (2006.01) |
| ***C10M 145/14*** | (2006.01) |
| ***C10M 169/04*** | (2006.01) |
| ***C10M 173/02*** | (2006.01) |

(52) U.S. Cl.

CPC ..... *C10M 169/044* (2013.01); *C10M 105/04* (2013.01); *C10M 105/24* (2013.01); *C10M 129/16* (2013.01); *C10M 133/04* (2013.01); *C10M 145/14* (2013.01); *C10M 169/048* (2013.01); *C10M 173/02* (2013.01); *C10M 2205/14* (2013.01); *C10M 2205/143* (2013.01); *C10M 2207/022* (2013.01); *C10M 2207/04* (2013.01); *C10M 2207/10* (2013.01); *C10M 2207/122* (2013.01); *C10M 2207/126* (2013.01); *C10M 2207/1253* (2013.01); *C10M 2209/084* (2013.01); *C10M 2209/0845* (2013.01); *C10M 2215/042* (2013.01); *C10N 2210/02* (2013.01); *C10N 2230/12* (2013.01); *C10N 2240/402* (2013.01); *C10N 2250/121* (2013.01)

(58) Field of Classification Search

CPC ..... C10M 2205/14; C10M 2205/143; C10M 2207/022; C10M 2207/04; C10M 2207/122; C10M 2207/1253; C10M 2207/126; C10M 2209/084; C10M 2209/0845; C10M 2215/042; C10M 2207/10; C10N 2230/12; C10N 2240/402; C10N 2250/121; C10N 2210/02

USPC ..... 508/507; 72/42

See application file for complete search history.

(56) References Cited

U.S. PATENT DOCUMENTS

| | | | |
|---|---|---|---|
| 3,568,486 | A | 3/1971 | Rosenberg et al. |
| 3,974,674 | A | 8/1976 | Orozco et al. |
| 2002/0086921 | A1 | 7/2002 | Zedda et al. |
| 2008/0026157 | A1 | 1/2008 | Jung et al. |
| 2010/0167968 | A1 | 7/2010 | Pinel et al. |
| 2011/0285124 | A1 | 11/2011 | Pinel et al. |
| 2012/0285293 | A1 | 11/2012 | Mirchandani et al. |
| 2013/0144264 | A1 | 6/2013 | Shalaby et al. |

FOREIGN PATENT DOCUMENTS

| | | |
|---|---|---|
| EP | 1378345 | 1/2004 |
| WO | WO-99/64544 | 12/1999 |

OTHER PUBLICATIONS

International Search Report dated Nov. 20, 2014 in corresponding International Application No. PCT/US14/39096, filed May 22, 2014.

Written Opinion dated Nov. 20, 2014 in corresponding International Application No. PCT/US14/39096, filed May 22, 2014.

Extended European Search Reporting dated Feb. 10, 2017 in related European Application No. 14823411.5, filed May 22, 2014.

International Preliminary Report on Patentability dated Jan. 21, 2016 in corresponding International Patent Application No. PCT/US2014/039096, filed May 22, 2014.

Di Crescenzo, D et al, Lubricants and Accelerated Test Methods for Expandable Tubular Application, SPE/IADC Drilling Conf and Exhibition, UK, Mar. 17, 2015.

Response filed Aug. 29, 2017 to Extended European Search Reporting dated Feb. 10, 2017 in related European Application No. 14823411.5, filed May 22, 2014.

*Primary Examiner* — Vishal V Vasisth

(74) *Attorney, Agent, or Firm* — Howson & Howson LLP; Mary E. Bak

(57) ABSTRACT

The present invention provides metal shaping compositions and processes for using same for shaping metal substrates. Specifically, the metal shaping composition discussed herein are environmentally-friendly, water-containing composition which provide excellent lubricity under metal shaping process conditions while also providing excellent rust protection. The metal shaping compositions discussed herein contain (i) a film-forming lubricant capable of being solubilized into water in dispersible or emulsifiable form and which softens at a temperature of about 80 to about 200° C.; (ii) a film forming polymeric binder capable of being solubilized into water in dispersible or emulsifiable form; (iii) a solid lubricant capable of being solubilized into water in dispersible or emulsifiable form; and (iv) a corrosion inhibitor.

16 Claims, No Drawings

COMPOSITIONS AND USE THEREOF FOR METAL SHAPING

CROSS-REFERENCE TO RELATED APPLICATIONS

This application is a national stage of International Patent Application No. PCT/US2014/039096, filed May 22, 2014, which claims the benefit of the priority of U.S. Provisional Patent Application No. 61/845,348, filed Jul. 11, 2013, which applications are incorporated herein by reference.

BACKGROUND

This invention relates to aqueous metal shaping compositions and processes for using these compositions.

Metal shaping has been an integral part of industrial innovation going back hundreds of years. Metal shaping is performed in a wide variety of commercial industries and results in products utilized by a vast majority of the world population.

Metal shaping is typically achieved by applying a mechanical force to a metal substrate. As a die forms a shape from a metal blank, the metal blank moves into the shape of the die. The flow of the metal is controlled through pressure applied to the blank and lubrication applied to the die or the blank. If the form moves too easily, wrinkles can occur. To correct this, more pressure or less lubrication must be applied to the blank to limit the flow of material and cause the material to stretch or thin. However, if too much pressure is applied, the shaped metal piece can become too thin and break.

Metal shaping is utilized in a wide variety of industries to prepare metal products for both personal and commercial uses. Recent advances in the metal shaping art have resulted in the use of metal shaping compositions which are applied to the metal substrate prior to application of the mechanical force. The success of metal shaping is not only dependent on the flow and stretch of the metal, but the properties conveyed by the metal shaping composition. However, these metal shaping compositions do not provide sufficient anticorrosive properties.

Significant technical advances have resulted in improved compositions for shaping metals and processes using same. However, what is still needed in the art are compositions and methods for shaping metals which are resistant to corrosion.

SUMMARY OF THE INVENTION

In one aspect, a composition is provided and contains (i) a film forming lubricant capable of being solubilized into water in dispersible or emulsifiable form and which softens at a temperature of about 80 to about 200° C.; (ii) a film forming polymeric binder capable of being solubilized into water in dispersible or emulsifiable form; (iii) a solid lubricant capable of being solubilized into water in dispersible or emulsifiable form; and (iv) a corrosion inhibitor. In one embodiment, the composition further contains one or more coalescing/drying agent.

In another aspect, a composition is provided and contains (i) a wax capable of being dispersed, emulsified, or solubilized into water and which softens at a temperature of about 80 to about 200° C.; (ii) a film forming polymeric binder capable of being solubilized into water in dispersible or emulsifiable form; (iii) a solid lubricant capable of being solubilized into water in dispersible or emulsifiable form; and (iv) a corrosion inhibitor. In one embodiment, the composition further contains one or more coalescing/drying agent. In one embodiment, the wax is a polyethylene wax emulsion.

In a further aspect, a composition is provided and contains (i) a film-forming lubricant capable of being solubilized into water in dispersible or emulsifiable form and which softens at a temperature of about 80 to about 200° C.; (ii) acrylic-based polymer; (iii) a solid lubricant capable of being solubilized into water in dispersible or emulsifiable form; and (iv) a corrosion inhibitor.

In yet another aspect, a composition is provided and contains (i) a film-forming lubricant capable of being solubilized into water in dispersible or emulsifiable form and which softens at a temperature of about 80 to about 200° C.; (ii) a film forming polymeric binder capable of being solubilized into water in dispersible or emulsifiable form; (iii) a metal stearate; and (iv) a corrosion inhibitor. In one embodiment, the metal stearate is calcium stearate.

In still a further aspect, a composition is provided and contains (i) a film-forming lubricant capable of being solubilized into water in dispersible or emulsifiable form and which softens at a temperature of about 80 to about 200° C.; (ii) a film forming polymeric binder capable of being solubilized into water in dispersible or emulsifiable form; (iii) a solid lubricant capable of being solubilized into water in dispersible or emulsifiable form; and (iv) an alkanolamine salt. In one embodiment the alkanolamine salt is an alkanolamine carboxylic acid salt.

In another aspect, a composition is provided and contains (i) a film-forming lubricant capable of being solubilized into water in dispersible or emulsifiable form and which softens at a temperature of about 80 to about 200° C.; (ii) a film forming polymeric binder capable of being solubilized into water in dispersible or emulsifiable form; (iii) a solid lubricant capable of being solubilized into water in dispersible or emulsifiable form; (iv) a corrosion inhibitor; and (v) a rheology modifier. In one embodiment, the composition further contains one or more coalescing/drying agent. In one embodiment, the rheology modifier is a polyalkylene glycol.

In a further aspect, a method for shaping a metal substrate is provided and includes applying a composition described herein to a metal substrate and shaping the metal substrate. In one embodiment, the metal shaping includes bending drawing, expansion, reduction, stamping, heading, or hydroforming.

In yet another aspect, a method for preventing metal corrosion before, while, or after shaping the metal substrate and the method includes applying a composition described herein to a metal substrate and shaping the metal substrate. In one embodiment, the metal shaping includes bending, drawing, expansion, reduction, stamping, heading, or hydroforming.

In still a further aspect, a method for preventing galling or seizing of a metal substrate before, while, or after shaping the metal substrate is provided and includes applying a composition described herein to a metal substrate and shaping the metal substrate. In one embodiment, the metal shaping includes bending, drawing, expansion, reduction, stamping, heading, or hydroforming.

Other aspects, embodiments, and advantages of the process and system will be readily apparent from the following detailed description of the invention.

DETAILED DESCRIPTION OF THE INVENTION

The present invention overcomes the deficiencies in the art and provides a metal shaping composition which prevents or inhibits metal corrosion during its shaping. The term "corrosion" as used herein refers to oxidation of the metal substrate being shaped. In one embodiment, the metal shaping compositions result in less than about 5% by weight of corrosion. In another embodiment, the metal shaping compositions result in less than 5, 4, 3, 2, or 1% by weight of corrosion. In a further embodiment, the metal shaping compositions result in no corrosion of the metal substrate.

The metal shaping composition also successfully shapes a metal substrate without the undesirable side effect of removing any of the metal substrate. By doing so, the metal shaping compositions and processes using the same are fast, efficient, and result in a shaped metal product with the correct form and metal thickness. Accordingly, the metal shaping compositions may be utilized in a wide variety of industries including, without limitation, oil, gas, automotive, airspace, defense, industrial and consumer appliance. In one embodiment, the oil and gas industry utilizes metal shaping in its borehole drilling process and includes tubular expansion of the pipes required for the well construction. Specifically, the diameter of each segment of pipe going down the borehole is consequently increased during shaping process to the diameter of segment above, thereby permitting maintaining the same pipe diameter for the whole length of borehole and, ultimately, it makes the oil and gas production more efficient.

The inventors also found that components of the metal shaping composition act synergistically and provide the enhanced metal shaping properties.

The term "metal" or "metal substrate" as used herein is meant to include any metal or metal alloy which is capable of being shaped. One of skill in the art will be able to select the metal or metal alloy based on the cast metal or cast metal alloy to be prepared. Specific examples of metals that can be treated according to the shaping methods described herein include those known in the art including, without limitation, iron, aluminum, copper, zinc, magnesium, molybdenum, nickel, titanium, tungsten, lead, chromium, zirconium, cobalt, columbium, (niobium), vanadium, zirconium, tin, or titanium. In one embodiment, the metal substrate contains one metal. In another embodiment, the metal substrate is a metal alloy. The term "metal alloy" as used herein refers to a metal mixture containing two or more metals or at least one metal and at least one non-metallic element, provided that the combination of metals or metal with the non-metallic element results in a stable substrate. The "non-metallic element" may be selected by one of skill in the art and may include, without limitation, manganese, silicon, sulfur, phosphorus, or carbon, among others. In a further embodiment, the metal alloy is carbon steel or stainless steel.

Employing the methods and system described herein, the resultant metal substrate is not negatively impacted, i.e., it retains its desired porosity ductility, strength such as an excellent strength-to-weight ratio, weight, shape, corrosion resistance, mechanical properties, such as good thermal electrical conductivity, high temperature resistance, hardness, wear resistance, durability, and dimensional stability, among others.

The metal, metal substrate, or metal blank may be in a variety of physical shapes or forms. In one embodiment, the metal substrate is in the form of a sheet, bar, wire, coil, rod, block, or pipe. In another embodiment, the metal substrate is in the form of a sheet.

Another advantage of the metal shaping composition is that it is aqueous. By being aqueous, the metal shaping composition of the present invention is less hazardous, e.g., fewer fumes and fire hazards, as compared to metal shaping compositions in the art containing primarily organic solvents. Since the metal shaping compositions are aqueous, the water is readily evaporated after application to the metal substrate. By doing so, the solid lubricant is retained on the metal substrate for use in the metal shaping process.

The term "aqueous" as used herein refers to the presence of water in the metal shaping composition. In one embodiment, the term aqueous refers to the metal shaping compositions which contains more water than organic solvent. In one embodiment, the metal shaping compositions discussed herein contain less than about 10% by weight of organic solvents. In another embodiment, the metal shaping compositions contain less than about 9, 8, 7, 6, 5, 4, 3, 2, or 1% by weight of organic solvent. In a further embodiment, the metal shaping compositions contain about 0% by weight of organic solvent. However, the presence of an organic solvent in the metal shaping compositions at amounts less than about 10% by weight does not limit the productivity and effectiveness of the metal shaping compositions.

A further advantage of the metal shaping composition is that it maintains a thin lubricating film under process conditions. By doing so, friction, galling, and/or seizing of the metal shaping equipment is reduced or eliminated.

I. The Metal Shaping Composition

It is an advantage of the metal shaping composition of the invention that it does not phase separate. This advantage is desirable to the customer who is not required to ensure that the metal shaping composition is sufficiently mixed for use in the metal shaping process. By doing so, it is not necessary for the customer to monitor the metal shaping composition during the metal shaping process to ensure that it is sufficient mixed, i.e., homogenous.

The term "separated" is utilized herein to describe the separation of the components of the shaping composition. Specifically, the components of the shaping composition are "sufficiently" or "essentially" miscible such that the properties of the composition are not compromised. In one embodiment, the components of the shaping composition are at least 90% emulsified when combined. In a further embodiment, the components of the shaping composition are 90, 91, 92, 93, 94, 95, 96, 97, 98, 99, or 100% emulsified when combined. In another embodiment, the components of the shaping composition are at least 99% miscible. In a further embodiment, the components of the shaping composition are at least 99.1, 99.2, 99.3, 99.4, 99.5, 99.6, 99.7, 99.8, or 99.9% miscible. In yet another embodiment, the components of the shaping composition are 100% miscible.

The present invention therefore provides a composition containing (i) a film-forming lubricant capable of being solubilized into water in dispersible or emulsifiable form and which softens at a temperature of about 80 to about 200° C., (ii) a film forming polymeric binder capable of being solubilized into water in dispersible or emulsifiable form, (iii) a solid lubricant capable of being solubilized into water in dispersible or emulsifiable form, and (iv) a corrosion inhibitor.

As a first component, the composition contains a film-forming lubricant capable of being solubilized into water in dispersible or emulsifiable form. In one embodiment, the film-forming lubricant capable of being solubilized into water in dispersible or emulsifiable form is a wax capable of being dispersed, emulsified, or solubilized into water. In another embodiment, the wax is a polyethylene wax emulsion. Desirably, the first component has an average particle size of about 0.001 to about 1.5 μm, i.e., 0.001, 0.005, 0.01, 0.05, 0.1, 0.5, 1, 1.5, or integers, fractions or ranges there between. In one embodiment, the first component has an average particle size of about 0.01 to about 0.1 μm. It is also desirable that the first component softens at a temperature of about 80 to about 200° C., i.e., 80, 90, 100, 110, 120, 130, 140, 150, 160, 170, 180, 190, 200° C., or integers, fractions, or ranges there between. In one embodiment, the first component softens at a temperature of about 120 to about 180° C. The composition may contain about 5 to about 32% by weight, i.e., 5, 10, 15, 20, 25, 30, 31, 32%, or integers, fractions, or ranges there between, of the first component.

The phrase "dispersible" or "emulsifiable" as used herein refer to the ability of a component of the composition to disperse into a liquid medium. In one embodiment, the liquid medium is a carrier such as water. In another embodiment, the component disperses evenly throughout the liquid medium. In a further embodiment, the component disperses substantially evenly throughout the liquid medium. One of skill in the art would be able to determine if a component disperses or emulsifies in liquid medium.

The phrase "film-forming" as used herein refers to the ability of a component to coat a metal surface.

The second component of the metal shaping composition is a film forming polymeric binder capable of being solubilized into water in dispersible or emulsifiable form. In one embodiment, the second component is an acrylic-based polymer. The second component may also contain one or more of water, a surfactant, or emulsifying agent. The composition may contain about 2 to about 15% by weight, i.e., 2, 3, 4, 5, 6, 7, 8, 9, 10, 11, 12, 13, 14, 15%, or integers, fractions, or ranges there between, of the second component. In one embodiment, the composition may contain about 5 to about 10% by weight of the second component.

The metal shaping composition also includes, a third component, a solid lubricant capable of being solubilized into water in dispersible or emulsifiable form. In one embodiment, the third component contains a metal stearate. In another embodiment, the third component is calcium stearate. In a further embodiment, the third component may also contain one or more of water, a surfactant, or emulsifying agent. The composition may contain about 10 to about 40% by weight, i.e., 10, 15, 20, 25, 30, 35, 40%, or integers, fractions, or ranges there between, of the third component. In one embodiment, the composition contains about 20 to about 30% by weight of the third component.

The fourth component of the metal shaping composition is a corrosion inhibitor. In one embodiment, the corrosion inhibitor contains an alkanolamine salt. In one embodiment, the corrosion inhibitor is an alkanolamine carboxylic acid salt. The composition may contain about 0.5 to about 10% by weight, i.e., 0.5, 1, 2, 3, 4, 5, 6, 7, 8, 9, 10%, or integers, fractions, or ranges there between, of the corrosion inhibitor. In one embodiment, the composition contains about 1 to about 5% by weight of the corrosion inhibitor.

II. Optional Components of the Metal Shaping Compositions

The metal shaping compositions may also contain one or more additional components.

The compositions discussed herein may also contain one or more coalescing/drying agent. In one embodiment, the composition may also contain one coalescing/drying agent. In another embodiment, the composition may also contain two coalescing/drying agents. In a further embodiment, the composition may also contain three coalescing/drying agents. In yet another embodiment, the coalescing/drying agent is a glycol ether. In still a further embodiment, the coalescing/drying agent is selected from among propylene glycol n-propyl ether, dipropylene glycol methyl ether, propylene glycol butyl ether, or combinations thereof. Desirably, the coalescing/drying agent has an evaporation rate of at least 1. In one embodiment, the coalescing/drying agent has an evaporation rate of about 1 to about 30, i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30, or integers, fractions or ranges there between. In another embodiment, the coalescing/drying agent has an evaporation rate of about 5 to about 20. The composition contains sufficient amount of the coalescing/drying agent to accelerate drying of the composition on the metal substrate. In one embodiment, the composition contains about 0.001 to about 5% by weight of the coalescing/drying agent, or integers, fractions, or ranges there between. In another embodiment, the composition contains about 1 to about 4%, i.e., 1, 2, 3, or 4, by weight of the coalescing/drying agent.

The metal shaping compositions discussed herein may also contain one or more of a rheology modifier. In one embodiment, the rheology modifier is a polyalkylene glycol. In another embodiment, the metal shaping composition contains about 0.01 to about 2%, i.e., 0.01, 0.05, 0.1, 0.5, 1, 1.5, or 2% by weight, or integers, fractions, or ranges there between, of the rheology modifier.

The compositions discussed herein may also contain a carrier. In one example, the carrier is water. The carrier may be included in the shaping composition, thereby permitting use of the product by the customer without addition of further carrier. Alternatively, the carrier is present in the shaping composition in sufficient amounts to provide a stable solution for further dilution by the customer prior to use. The carrier may also be added by the customer to a concentrated shaping composition prior to use. However, more water may be added to the composition to ensure that the final medium contains sufficient water for use by the customer.

The shaping composition may also contain one or more of water, ester, carboxylic acid, surfactant, fatty acid, emulsifier, amine, thickener, lubricant, dispersant, antioxidant, alkaline compound, builder, solvent, surfactant, carrier, biocide, preservative, buffer, metal deactivator, dye, fragrance, caustic agent, wetting agent, sequestering agent, fungicide, and defoamer, among others.

"Antioxidants" as described herein are useful additives for preventing the degradation of the shaping compositions. Such antioxidants may be selected from among aminic and phenolic compounds.

C. Methods/Processes of Using the Metal Shaping Compositions

Metal shaping processes are those in which force is applied to a piece of a metal substrate to modify its geometry rather than remove any material. The applied force stresses the metal substrate and causes the metal substrate to deform, but not to fail. By doing so, the metal blank can be bent or stretched into a variety of complex shapes. Metal shaping processes useful herein include, without limitation, bending, roll forming, spinning, drawing including deep drawing, stretch forming, hydroforming, stamping, pressing, heading, expansion, and reduction. Such metal shaping processes are known in the art and include those known in the art.

The term "bending" includes applying a force to a metal blank, such as a sheet, causing it to bend at an angle and form the desired shape.

The phrase "roll forming" includes the progressive shaping of a metal blank, such as a sheet, through a series of bending operations using roller dies. The shape and size of the roller die may be unique.

The term "spinning" is used interchangeably with "spin forming is" and refers to a metal shaping process used to form cylindrical parts by rotating a metal blank, such as a metal sheet, while applying forces to one side of the metal blank. A sheet metal disc is rotated at high speeds and rollers press the metal blank against a tool to form the desired shape. Examples include cookware, hubcaps, satellite dishes, rocket nose cones, and musical instruments.

The term "drawing" as used herein refers to a method of stretching a metal blank, such as a sheet, wire, bar, and tube. Drawing may be performed at room temperature or at elevated temperatures. Bar, tube, and wire drawing all are performed by drawing the metal piece through a die to reduce the diameter and increase the length. Wire drawing produces flexible metal wire by drawing the metal substrate through a series of dies of decreasing size. The phrase "deep drawing" as used herein entails stretching a metal blank, such as a sheet, into the desired shape. A tool pushes downward on the metal blank, forcing it into a die cavity in the shape of the cup-shaped part. Examples of parts formed with deep drawing include automotive bodies and fuel tanks, cans, cups, kitchen sinks, and pots and pans.

The phrase "stretch forming" refers to a metal shaping process in which a metal blank, such as a sheet, is stretched and bent simultaneously over a die in order to form large contoured parts. Stretch forming is performed on a stretch press, in which a metal blank is securely gripped along its edges by gripping jaws.

"Hydroforming" as used herein is a cost-effective way of shaping metal substrates into lightweight, structurally stiff and produces stronger, lighter, and more rigid structures for vehicles. As used herein, hydroforming uses a metal shaping fluid to press room temperature metals into a die. Hydroforming permits the formation of complex shapes with concavities.

The terms "stamping" and "pressing" are used interchangeably and include a variety of metal blank forming manufacturing processes, such as punching using a machine press or stamping press, blanking, embossing, bending, flanging, and coining.

The term "heading" refers to the process of transforming a wire into a shaped part with tight and repetitive tolerances. Specifically, heading uses dies and punches to convert a specific metal slug into a finished shaped part of the exact same volume.

The term "expansion" as used herein refers to a process of shaping a metal substrate via expansion. In one embodiment, expansion of a metal substrate permits the insertion or removal of another component.

The term "reduction" as used herein refers to a process of reducing or changing the cross-sectional area of a metal u substrate sing a force exerted by one or more rotating rolls.

Any of these metal shaping methods include first applying the metal shaping composition described herein to a metal substrate as described above. In one embodiment, the metal shaping composition is applied to the metal using spraying, contact rolling, squeegeeing, dipping, brushing, or flooding application techniques. In another embodiment, the metal shaping composition is applied to the metal substrate using spraying techniques known to those skilled in the art.

"Contact rolling" as used herein is meant to describe application of a liquid by first soaking a rolling applicator in the composition and then pressing and rolling the wetted applicator to the metal substrate surface.

"Squeegeeing" as used herein is meant to describe application of pouring the composition on to the metal substrate surface and then spreading it uniformly using a smooth rubber applicator.

The present invention therefore provides methods for shaping a metal by using the compositions described herein. Specifically, the methods include applying a composition described herein to a metal substrate and shaping the metal substrate.

Also provided are methods for preventing metal corrosion before, while, or after shaping the metal substrate using the compositions described herein. Specifically, the methods include applying a composition described herein to a metal substrate and shaping the metal substrate.

Further provided are methods for preventing galling or seizing of a metal substrate before, while, or after shaping the metal substrate. Specifically, the methods include applying a composition described herein to a metal substrate and shaping the metal substrate.

In some instances, it may be necessary for the customer to dilute or "thin" the metal shaping composition prior to application to the metal substrate. This determination can readily be determined by one skilled in the art. Desirably, the metal shaping composition is diluted using water. One of skill in the art would also readily be able to determine how much water must be added to the metal shaping composition prior to its used in the methods discussed herein.

It may also be necessary for the customer to ensure that the metal shaping equipment is clean, i.e., substantially free from contaminants such as dust, grease, oil, or combinations thereof. The term "substantially" as used herein to describe the cleanliness of the metal shaping equipment refers to the equipment being at least about 90% clean, i.e., having less than about 10% by area of one or more contaminant. In one embodiment, the metal shaping equipment is at least about 90, 91, 92, 93, 94, 95, 96, 97, 98, 99, or 100% clean.

After its application, the metal shaping composition is permitted to dry. In one embodiment, the metal shaping composition is dry after at least about 1 hour. In another embodiment, the metal shaping composition is dry after at least about 1, 2, 3, 4, 5, 6, 7, 8, 9, 10, 11, 12, 13, 14, 15, 16, 17, 18, 19, 20, 21, 22, 23, or 24 hours. In a further embodiment, the metal shaping compositions is dry to the touch after about 1 to about 2 hours. In another embodiment, the metal shaping composition is completely dry on the metal substrate surface after about 24 hours. One of skill in the art would readily be able to determine the required time for the metal shaping composition to dry and is dependent on the process temperature, temperature of the surrounding environment, environment humidity, and ventilation, among others. Specifically, the drying times for the metal shaping compositions may be longer in lower temperatures, high humidities, and poorly ventilated areas. One of skill in the art would also be able to determine how to measure the dryness of the metal shaping composition on the metal substrate.

The thickness of the composition on the metal substrate is dependent on the amount of composition applied to the metal substrate. One of skill in the art would be able to determine the final thickness of the dried metal shaping composition depending on the particular metal substrate and shaping process. In one embodiment, the shaping composition dries to a thickness on the metal substrate of about 0.2 to about 5 mil, i.e., 0.2, 0.5, 1, 1.5, 2, 2.5, 3, 3.5, 4, 4.5, or 5 mil, or fractions or ranges there between. In another embodiment, the composition dries to a thickness on the metal substrate of about 1.5 to about 2.5 mil.

The metal shaping processes discussed herein may be performed at a variety of temperatures. Advantageously, the metal shaping compositions are effective at shaping metal substrates at a variety of temperatures. In one embodiment, the metal shaping compositions are effective at shaping metals at room temperature. In another embodiment, the metal shaping compositions are effective at temperatures of less than room temperature. In a further embodiment, the metal shaping compositions are effective a temperature of about 5° C. or less. In yet a further embodiment, the metal shaping compositions are effective at temperatures of greater than room temperature. In still another embodiment, the metal shaping compositions are effective at temperatures of about room temperature to about 200° C.

Importantly, the dried metal shaping composition does not loosen or chip from the metal substrate surface prior to the metal shaping process (i.e. during transport and/or typical handling). Because the metal shaping composition is effectively affixed to the metal substrate, the customer advantageously has the option of transporting the coated metal substrate. This thereby permits the movement of the coated metal substrate from one piece of machinery to another within a plant. Alternatively, this permits one plant to coat the metal substrate and a second plant to shape the coated metal substrate to form the final product.

Once the metal shaping composition has dried on the metal substrate, the metal substrate is shaped using a process described above.

D. Products for Use in the Processes

As discussed above, the present invention provides a composition which contains at least four reagents. In one embodiment, each reagent is in a separate container. These reagents include a film-forming lubricant capable of being solubilized into water in dispersible or emulsifiable form and which softens at a temperature of about 80-200° C., a film forming polymeric binder capable of being solubilized into water in dispersible or emulsifiable form, a solid lubricant capable of being solubilized into water in dispersible or emulsifiable form and a corrosion inhibitor.

Also envisioned by the present invention is a product including the components of the composition discussed herein. In one embodiment, the product includes a first container which includes a film-forming lubricant capable of being solubilized into water in dispersible or emulsifiable form and which softens at a temperature of about 80 to about 200° C., a second container including a film forming polymeric binder capable of being solubilized into water in dispersible or emulsifiable form, a third container including a solid lubricant capable of being solubilized into water in dispersible or emulsifiable form, a fourth container including a corrosion inhibitor, and instructions for using the product.

Additional containers may be further included in the product, i.e., the product may include a fifth or more container which contains other reagents which may optionally be added to the components of the composition. However, the additional, if any, component(s) must not affect the function or overall performance of composition. Optional components of the product include one or more of a container including a first coalescing/drying agent, a container including a second coalescing/drying agent, a container including a third coalescing/drying agent, a container containing a rheology modifier, or combinations thereof.

Such a product may further contain safety equipment such as disposable gloves, pumps, gases, masks, suits, glasses, decontamination instructions, and the like. However, one of skill in the art could readily assemble any number of products with the information and components necessary to perform processes of the present invention.

E. Desirable Embodiments of the Present Invention

In one embodiment, a composition is provided and contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and a corrosion inhibitor.

In another embodiment, a composition is provided and contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, a corrosion inhibitor and one or more coalescing/drying agent. In one example, the coalescing/drying agent is a glycol ether. In one example, the composition contains 0.001 to about 5% by weight of the coalescing/drying agent.

In a further embodiment, a composition is provided and contains a polyethylene wax emulsion, a film forming polymeric binder capable of being solubilized into water in dispersible or emulsifiable form, a solid lubricant capable of being solubilized into water in dispersible or emulsifiable form, and a corrosion inhibitor. In one example, the composition contains about 5 to about 32% by weight of the polyethylene wax emulsion.

In yet another embodiment, a composition is provided and contains a film-forming lubricant capable of being solubilized into water in dispersible or emulsifiable form and which softens at a temperature of about 80 to about 200° C., an acrylic-based polymer, a solid lubricant capable of being solubilized into water in dispersible or emulsifiable form, and a corrosion inhibitor. In one example, the composition contains about 2 to about 15% by weight of the acrylic-based polymer.

In still a further embodiment, a composition is provided and contains a film-forming lubricant capable of being solubilized into water in dispersible or emulsifiable form and which softens at a temperature of about 80 to about 200° C., a film forming polymeric binder capable of being solubilized into water in dispersible or emulsifiable form, calcium stearate, and a corrosion inhibitor. In one example, the composition contains about 10 to about 40% by weight of the solid lubricant.

In another embodiment, a composition is provided and contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and an alkanolamine carboxylic acid salt. In one example, the composition contains about 0.5 to about 10% by weight of the alkanolamine carboxylic acid salt.

In still a further embodiment, a composition is provided and contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, a corrosion inhibitor, and rheology modifier. In one example, the rheology modifier is a polyalkylene glycol. In another example, the composition contains about 0.01 to about 2% by weight of the rheology modifier.

In yet another embodiment, a method for shaping a metal substrate is provided and includes (i) applying a composition that contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and a corrosion inhibitor and (ii) shaping the metal substrate.

In a further embodiment, a method for preventing metal corrosion before, while, or after shaping a metal substrate is provided and includes (i) applying a composition that contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and a corrosion inhibitor and (ii) shaping the metal substrate.

In another embodiment, a method for preventing galling or seizing of a metal substrate before, while, or after shaping the metal substrate and includes (i) applying a composition that contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and a corrosion inhibitor and (ii) shaping the metal substrate. In one example, the shaping includes drawing, stamping, expansion, reduction, heading, or hydroforming.

In still a further embodiment, a method for preventing galling or seizing of a metal substrate before, while, or after shaping the metal substrate and includes (i) applying a composition that contains a film-forming lubricant capable of being solubilized into water in dispersible or emulsifiable form and which softens at a temperature of about 80 to about 200° C., a film forming polymeric binder capable of being solubilized into water in dispersible or emulsifiable form, a solid lubricant capable of being solubilized into water in dispersible or emulsifiable form, and a corrosion inhibitor, (ii) shaping the metal, and (iii) drying the composition on the metal prior to shaping the metal substrate. In one example, the shaping includes drawing, stamping, expansion, reduction, heading, or hydroforming.

It should be understood that while various embodiments in the specification are presented using "comprising" language, under various circumstances, a related embodiment is also be described using "consisting of" or "consisting essentially of" language.

It is to be noted that the term "a" or "an", refers to one or more, for example, "a metal shaping composition" is understood to represent one or more metal shaping compositions. As such, the terms "a" (or "an"), "one or more" and "at least one" are used interchangeably herein.

Unless defined otherwise in this specification, technical and scientific terms used herein have the same meaning as commonly understood by one of ordinary skill in the art to which this invention belongs and by reference to published texts, which provide one skilled in the art with a general guide to many of the terms used in the present application.

Clearly, one of skill in the art may modify the above systems and processes, such as by automation, computer processing, adjusting the size and lengths of tanks, conduits, placement of pumps and the like. Such modifications are within the skill of the art given this disclosure.

The following example demonstrates the use of a composition discussed herein for shaping a metal substrate. This example is illustrative only and are not intended to be a limitation on the present invention.

Example 1

A metal shaping composition was prepared and contained the components noted in Table 1.

TABLE 1

| Component | Amount (% by weight) |
|---|---|
| Polyethylene wax emulsion | 30.65 |
| Acrylic emulsion | 12.8 |
| Mixture of ether-based coalescing agents | 3.2 |
| Metal stearate salt dispersion | 50.0 |
| Mixture of alkanolamine carboxylic acid salts | 3 |
| Rheology Modifier | 0.35 |

By doing so, a metal shaping composition was prepared having the properties as outlined in Table 2 and was successful in shaping metal.

TABLE 2

| | |
|---|---|
| Appearance | White liquid |
| Odor | Bland |
| Shelf Life | 180 days |
| Specific gravity @ 60° F. | 1.01 pounds/gallon |
| Specific gravity @ 75° F. | 8.4323 pounds/gallon |
| pH (neat) | 10.4 |

Each and every patent, patent application, and publication, including publications listed below and/or cited throughout the disclosure, and priority applications, including US Provisional Patent Application No. 61/845,348, is expressly incorporated herein by reference in its entirety. Embodiments and variations of this invention other than those specifically disclosed above may be devised by others skilled in the art without departing from the true spirit and scope of the invention. The appended claims include such embodiments and equivalent variations.

What is claimed is:

1. An aqueous composition comprising:

(i) about 5 to 32% by weight of a film-forming lubricant comprising a polyethylene emulsion capable of being solubilized into water in dispersible or emulsifiable form and which softens at a temperature of about 80 to about 200° C. and having an average particle size of 0.001 to 1.5 μm;

(ii) about 5 to 15% by weight of a film forming acrylic-based polymeric binder capable of being solubilized into water in dispersible or emulsifiable form;

(iii) about 10 to 50% by weight of a solid lubricant comprising a metal stearate capable of being solubilized into water in dispersible or emulsifiable form; and (iv) about 0.5 to about 10% by weight of a corrosion inhibitor; and (v) the balance water;

wherein said components are at least 90% emulsified when combined in a liquid medium and wherein said composition functions to maintain a thin lubricating film under metal shaping process conditions.

2. The composition according to claim 1, further comprising one or more of (a) a coalescing/drying agent; and (b) a rheology modifier.

3. The composition according to claim 2, wherein said coalescing/drying agent has an evaporation rate of about 1 to about 30.

4. The composition according to claim 2, wherein said coalescing/drying agent is a glycol ether, a propylene glycol n-propyl ether, a dipropylene glycol methyl ether, or a propylene glycol butyl ether.

5. The composition according to claim 2, comprising about 0.001 to about 5% by weight of said coalescing/drying agent.

6. The composition according to claim 1, wherein said solid lubricant is calcium stearate.

7. The composition according to claim 1, wherein said solid lubricant or said film-forming polymeric binder may independently further comprise one or more of water, a surfactant, or emulsifying agent.

8. The composition according to claim 1 comprising about 10 to about 40% by weight of said solid lubricant.

9. The composition according to claim 1, wherein said corrosion inhibitor comprises an alkanolamine salt or an alkanolamine carboxylic acid salt.

10. A method comprising:

(i) applying a composition of claim 1 to a metal substrate; and (ii) shaping said metal substrate, wherein said composition functions to maintain a thin lubricating film under metal shaping process conditions.

11. The method according to claim 10, wherein said shaping comprises one or more of:

(a) drawing said metal substrate;

(b) stamping said metal substrate;

(c) expansion or reduction; and (d) bending.

12. The method according to claim 10, wherein said shaping comprises heading.

13. The method according to claim 10, wherein said shaping comprises hydroforming.

14. The method according to claim 10, further comprising one or a combination of:

applying said composition to said metal substrate by spraying, dipping, flooding, contact rolling, squeegeeing, brushing or a combination thereof;

drying said composition on said metal substrate prior to shaping said metal substrate; and drying said composition to a thickness on said metal substrate of about 0.2 to 5 mil.

15. The method according to claim 10, wherein said metal substrate contains one metal or metal alloy or wherein said metal substrate is in the form of a pipe, sheet, block, bar, rod or wire.

16. The method according to claim 10, which prevents metal corrosion, galling or seizing of said metal substrate before, while, or after shaping said metal substrate.

* * * * *